US010890189B2

(12) United States Patent
Eslinger

(10) Patent No.: US 10,890,189 B2
(45) Date of Patent: Jan. 12, 2021

(54) SUBMERSIBLE PUMPING SYSTEM HAVING THRUST PAD FLOW BYPASS

(71) Applicant: Schlumberger Technology Corporation, Sugar Land, TX (US)

(72) Inventor: David Milton Eslinger, Collinsville, OK (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 392 days.

(21) Appl. No.: 15/170,891

(22) Filed: Jun. 1, 2016

(65) Prior Publication Data

US 2017/0350399 A1 Dec. 7, 2017

(51) Int. Cl.

| | |
|---|---|
| ***F04D 1/06*** | (2006.01) |
| ***F04D 13/08*** | (2006.01) |
| ***F04D 29/70*** | (2006.01) |
| ***F04D 29/44*** | (2006.01) |
| ***F04D 29/42*** | (2006.01) |

(Continued)

(52) U.S. Cl.

CPC ..... *F04D 1/06* (2013.01); *F04D 13/086* (2013.01); *F04D 29/0413* (2013.01); *F04D 29/167* (2013.01); *F04D 29/426* (2013.01); *F04D 29/445* (2013.01); *F04D 29/708* (2013.01); *F05B 2230/60* (2013.01); *F05B 2240/57* (2013.01)

(58) Field of Classification Search

CPC .. F16C 33/10; F16C 33/1005; F16C 33/1025; F16C 33/1045; F16C 33/1055; F16C 2360/44; F04D 17/12; F04D 1/06; F04D 29/445; F04D 29/708; F04D 29/167; F04D 29/0413; F04D 29/426; F04D 13/086; F05B 2230/60; F05B 2240/57

See application file for complete search history.

(56) References Cited

U.S. PATENT DOCUMENTS

| | | | |
|---|---|---|---|
| 1,037,243 | A | 9/1912 | Guy |
| 1,369,508 | A | 2/1921 | Weiner et al. |
| 1,483,645 | A | 2/1924 | Sessions |

(Continued)

FOREIGN PATENT DOCUMENTS

| | | | |
|---|---|---|---|
| CN | 1459003 | A | 11/2003 |
| CN | 1680728 | A | 10/2005 |

(Continued)

OTHER PUBLICATIONS

PCT/US2011/042690, International Search Report and Written Opinion, dated Mar. 28, 2012, 9 pgs.

(Continued)

*Primary Examiner* — Peter J Bertheaud
*Assistant Examiner* — Dnyanesh G Kasture

(57) ABSTRACT

A technique facilitates operation of a pump, such as a submersible pump in an electric submersible pumping system. The pump has a sequential diffuser and impeller which are operationally engaged via a thrust device. In some embodiments, the diffuser and impeller also are operationally engaged via a front seal. A bypass channel is used to route a flow of fluid from a tip region of the impeller to an inlet region of the impeller without passing through the thrust device during operation of the pump.

18 Claims, 4 Drawing Sheets

(51) Int. Cl.
*F04D 29/041* (2006.01)
*F04D 29/16* (2006.01)

(56) References Cited

U.S. PATENT DOCUMENTS

| | | | | |
|---|---|---|---|---|
| 1,609,306 | A | 12/1926 | Peterson | |
| 1,642,914 | A | 9/1927 | Whann | |
| 1,667,992 | A | 5/1928 | Sherwood et al. | |
| 2,145,597 | A | 1/1939 | Hait | |
| 2,775,945 | A | 1/1957 | Arutunoff | |
| 2,809,590 | A | 10/1957 | Brown | |
| 3,058,510 | A | 10/1962 | Tiraspolsky | |
| 3,228,342 | A | 1/1966 | Page | |
| 3,265,001 | A | 8/1966 | Deters | |
| 3,612,716 | A | 10/1971 | Deters | |
| 3,874,812 | A | 4/1975 | Hanagarth | |
| 3,964,836 | A | 6/1976 | Navelsaker | |
| 3,975,117 | A | 8/1976 | Carter | |
| 4,018,544 | A | 4/1977 | Eberhardt | |
| 4,363,608 | A | 12/1982 | Mulders | |
| 4,678,399 | A | 7/1987 | Vandevier et al. | |
| 4,741,668 | A * | 5/1988 | Bearden | F04D 7/04 415/196 |
| 4,838,758 | A | 6/1989 | Sheth | |
| 4,872,808 | A * | 10/1989 | Wilson | F04D 13/10 415/170.1 |
| 4,909,707 | A | 3/1990 | Wauligman et al. | |
| 5,133,639 | A | 7/1992 | Gay et al. | |
| 5,160,240 | A | 11/1992 | Wilson | |
| 5,201,848 | A | 4/1993 | Powers | |
| 5,308,169 | A * | 5/1994 | Baker | F01D 25/168 384/121 |
| 5,360,273 | A | 11/1994 | Buckmann | |
| 5,577,886 | A | 11/1996 | Arbeus | |
| 5,591,016 | A | 1/1997 | Kubota et al. | |
| 5,667,314 | A | 9/1997 | Limanowka et al. | |
| 5,690,471 | A | 11/1997 | Sasaki | |
| 5,722,812 | A | 3/1998 | Knox et al. | |
| 5,961,282 | A | 10/1999 | Wittrisch et al. | |
| 6,068,444 | A | 5/2000 | Sheth | |
| 6,106,224 | A * | 8/2000 | Sheth | F04D 29/0413 415/104 |
| 7,648,332 | B2 | 1/2010 | Eslinger et al. | |
| 8,337,142 | B2 | 12/2012 | Eslinger et al. | |
| 8,568,081 | B2 | 10/2013 | Song et al. | |
| 2008/0056879 | A1 | 3/2008 | Eslinger et al. | |
| 2011/0255951 | A1 | 10/2011 | Song et al. | |
| 2012/0020777 | A1 | 1/2012 | Eslinger | |
| 2013/0209225 | A1 | 8/2013 | Eslinger et al. | |
| 2014/0209291 | A1 * | 7/2014 | Watson | F04D 29/086 166/105 |

FOREIGN PATENT DOCUMENTS

| | | | |
|---|---|---|---|
| CN | 201225312 | Y | 4/2009 |
| CN | 202579293 | U | 12/2012 |
| EP | 0078345 | | 5/1983 |
| GB | 2339851 | | 2/2000 |
| JP | H07301192 | A | 11/1995 |
| WO | 2012003386 | A2 | 1/2012 |
| WO | 2016022123 | A1 | 2/2016 |

OTHER PUBLICATIONS

Examiner's Report issued in CA2803993, dated Nov. 27, 2014, 3 pgs.

Examiner's Report issued in CA2803993, dated Mar. 28, 2014, 4pgs.

PCT/US2014/050117, International Search Report and Written Opinion, dated Apr. 28, 2015, 8 pgs.

http://www.chemicalprocessing.com/industrynews/2005/092.html, 8 pgs.

http://www.engineersedge.com/pumps/wearing_rings.htm, downloaded 2020, available at least as early as Apr. 2012 (2 pages).

* cited by examiner

SUBMERSIBLE PUMPING SYSTEM HAVING THRUST PAD FLOW BYPASS

BACKGROUND

In many hydrocarbon well applications, electric submersible pumping (ESP) systems are used for pumping fluids, e.g. hydrocarbon-based fluids. For example, the ESP system may be conveyed downhole and used to pump oil from a downhole wellbore location to a surface collection location along a fluid flow path. The ESP system may utilize a submersible, centrifugal pump having a plurality of stages with each stage comprising an impeller and a diffuser. Each stage further comprises a stage front seal and a downthrust pad which may be used in combination with a thrust washer. During operation, a pressure drop occurs between a tip of the impeller and an inlet of the impeller and causes fluid flow through both the downthrust pad and the front seal. When pumping a fluid which contains solids, e.g. sand, the fluid flow through the downthrust pad and front seal can cause solids to move into the downthrust pad region. The solids can accelerate wear of the pad and/or thrust washer.

SUMMARY

In general, a system and methodology facilitate operation of a pump, such as a submersible pump in an electric submersible pumping system. The pump has a sequential diffuser and impeller which are operationally engaged via a thrust device. In some embodiments, the diffuser and impeller also are operationally engaged via a front seal. A bypass channel is used to route a flow of fluid from a tip region of the impeller to an intake region of the impeller without passing through the thrust device during operation of the pump.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
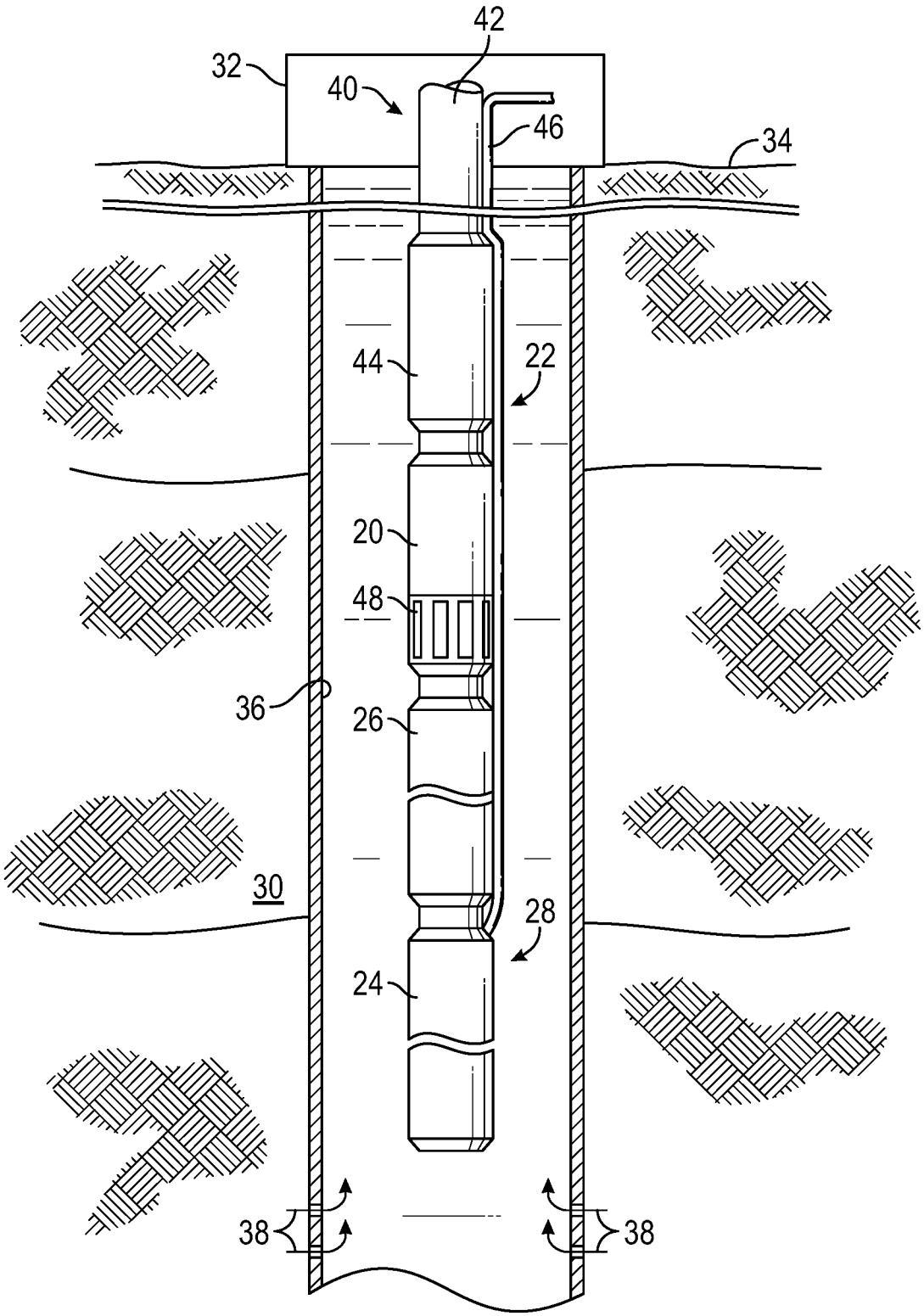
FIG. 1 is a schematic illustration of a well system comprising an example of a submersible, centrifugal pump incorporated into an electric submersible pumping system positioned in a borehole, e.g. a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate operation of a pump, such as a submersible pump in an electric submersible pumping system. According to an embodiment, the submersible pump is constructed as a centrifugal pump having at least one stage with an impeller and a diffuser. In many applications, the pump comprises a plurality of stages having sequential pairs of cooperating impellers and diffusers disposed within a surrounding pump housing. The impellers are rotated by a shaft and move relative to the diffusers to pump fluid along a primary flow path within the pump housing. In a given pump example, the pair or pairs of cooperating diffusers and impellers are each operationally engaged via a thrust device and a front seal. A bypass channel, e.g. a bypass slot(s), is used to route a flow of fluid from a tip region of the impeller to an inlet region of the impeller without passing through the thrust device during operation of the pump.

During operation of the pump, e.g. submersible pump, rotation of the impellers relative to the diffusers effectively pumps fluid along a primary flow path extending through the stages of sequentially stacked diffusers and impellers until discharged by the pump. In addition to this flow of fluid along the primary flow path, operation of the pump causes a secondary flow from an impeller tip region to an impeller inlet region of each impeller.

The flow of fluid along the secondary flow path is caused by a pressure drop between the impeller tip and the inlet of the impeller. The pressure differential causes fluid to flow through a clearance seal, e.g. front seal, between the impeller and the corresponding diffuser. The amount of secondary flow may be determined by the pressure drop and also by the resistance (or restriction) of the front seal established by the length and radial gap of the clearance seal. In currently available pumps, the secondary flow is forced to move through the thrust device as the fluid moves to the clearance seal and ultimately to the impeller inlet. When pumping fluid containing solids, e.g. sand, the flow through the thrust device tends to accelerate wear of thrust device components, e.g. thrust pads and/or thrust washers.

Embodiments described herein utilize features so that the secondary fluid flow moving through the front seal does not have to flow through the thrust device. A bypass conduit is used to route at least a portion of the secondary flow of fluid past the thrust device rather than through the thrust device. Additionally, the thrust device, e.g. thrust pad, may be separated from the front seal. The bypass conduit, e.g. bypass slots, may be constructed to have substantially lower flow resistance than the flow path through the thrust device, e.g. across a thrust pad contact surface.

The flow of fluid through the bypass conduit ensures that very few solids, e.g. sand, are carried into the thrust device, thus mitigating abrasive wear of thrust device components such as a thrust pad and/or thrust washer. In some embodiments, the thrust device region also may utilize features to further discourage entry of solids. An example of such a feature comprises a thrust washer retaining feature which extends into engagement with the thrust pad in a manner which blocks inflow of solids.

Referring generally to FIG. 1, an example of a pump 20, e.g. a submersible, centrifugal pump, is illustrated as deployed in a well-related application. However, the illustrated embodiment is simply provided as an example of numerous potential embodiments that benefit from the improved centrifugal pump 20. Referring again to FIG. 1, pump 20 is illustrated as deployed in a submersible pumping system 22, e.g. an electric submersible pumping system.

The submersible pumping system 22 may comprise a variety of components depending on the particular well application and/or environment in which it is used. In addition to the centrifugal pump 20, other components of submersible pumping system 22 may comprise at least one submersible motor 24 and at least one motor protector 26. The motor protector 26 enables pressure balancing of the internal motor fluid of submersible motor 24 with respect to the surrounding environment. The submersible pump 20, submersible motor 24, and motor protector 26 are coupled together into electric submersible pumping system 22 in a manner such that submersible motor 24 may be selectively operated to power the submersible pump 20.

The submersible pumping system 22 may be deployed in a wellbore 28 drilled into a geologic formation 30 containing, for example, desirable production fluids such as hydrocarbon-based fluids. In this embodiment, the wellbore 28 extends downwardly from a wellhead 32 positioned at a surface location 34. In some applications, the wellbore 28 may be lined with a wellbore casing 36 which may be perforated with a plurality of perforations 38 extending through the casing 36 and into the surrounding formation 30. The perforations 38 enable flow fluids between the surrounding formation 30 and the wellbore 28.

The submersible pumping system 22 may be deployed downhole into wellbore 28 via a conveyance 40. The conveyance 40 may have a variety of configurations and may comprise a tubing 42, e.g. coiled tubing or production tubing. However, other suitable conveyances, such as wireline or slick line, also may be used to deploy submersible pumping system 22. The conveyance 40 is coupled with submersible pumping system 22 by an appropriate connector 44.

Electric power may be provided to submersible motor 24 via a power cable 46 which extends downwardly along conveyance system 40 and submersible pumping system 22 for connection with submersible motor 24. The submersible motor 24, in turn, powers submersible, centrifugal pump 20 which then draws in fluid from wellbore 28 through a pump intake 48. By way of example, the submersible motor 24 may power submersible motor 24 via a shaft used to rotate at least one impeller and often a plurality of impellers. Within submersible pump 20, for example, a plurality of impellers may be rotated to pump fluid from intake 48, through submersible pump 20, and out through a pump discharge. The discharged fluid may be directed along tubing 42 (or along another suitable production flow path) to a desired location, such as a collection location at surface 34. However, various other components and system configurations may be utilized in a variety of pumping operations and environments.

Figure 2:
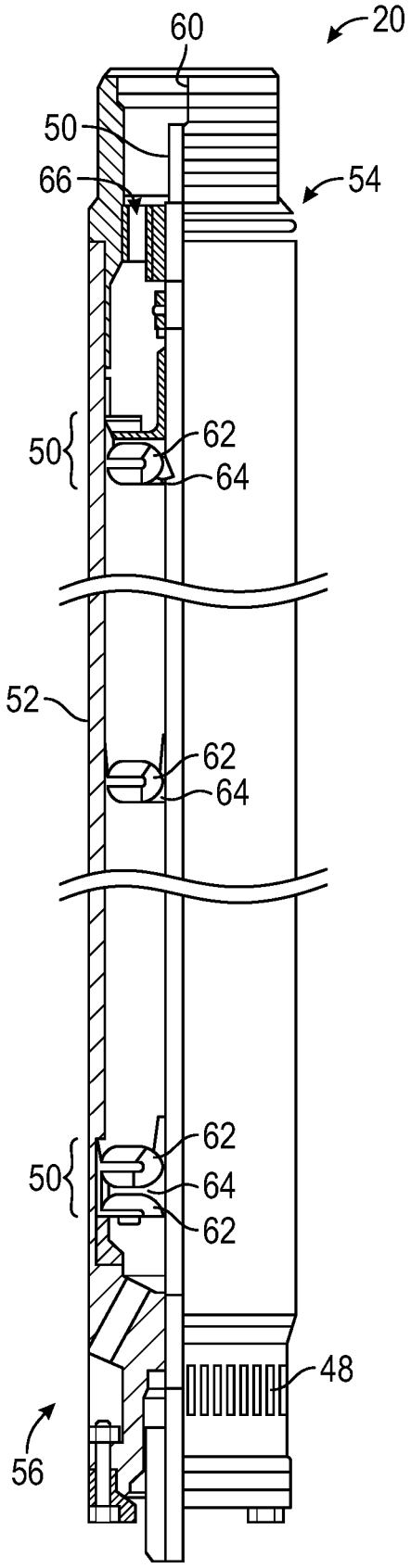
FIG. 2 is a partial cross-sectional view of an example of a submersible, centrifugal pump having a plurality of stages, according to an embodiment of the disclosure.

Referring generally to FIG. 2, an embodiment of pump 20 is illustrated in the form of a submersible, centrifugal pump. In this embodiment, the submersible pump 20 comprises a plurality of pumps stages 50 distributed along a substantial portion of its length. In FIG. 2, a relatively small number of the actual pump stages 50 are illustrated to facilitate explanation; however pumps stages 50 would tend to be distributed along a substantial length of the submersible pump 20. As illustrated, the submersible pump 20 also comprises an outer housing 52 which may be tubular in shape and extend between a first pump end 54 and a second pump end 56. The pump ends 54, 56 may comprise threaded ends for threaded engagement with adjacent pumping system components, e.g. motor protector 26 and connector 44. A shaft 58 may be rotatably mounted within the outer housing 52 generally along an axis 60 of the submersible, centrifugal pump 20.

The pumps stages 50 comprise a plurality of pairs of cooperating impellers 62 and diffusers 64. In each stage/pair 50, the impeller 62 is movably engaged with respect to the corresponding diffuser 64 and rotationally affixed with shaft 58. For example, the shaft 58 may be keyed or otherwise coupled with the plurality of impellers 62 so as to rotate the plurality of impellers 62 with respect to the plurality of corresponding diffusers 64. The shaft 58 is rotated by submersible motor 24.

During operation, the rotating impellers 62 effectively create a low-pressure or suction which draws fluid in through pump intake 48 and imparts motion to the fluid. The rotating impellers 62 cause the fluid to flow along a primary flow path through submersible pump 20 from one stage 50 to the next until the fluid is discharged through an outlet 66, e.g. outlet flow passages at pump end 54. The diffusers 64 are rotationally stationary within outer housing 52 and serve to guide the fluid from one impeller 62 to the next impeller 62 until discharged through outlet 66. By way of example, the diffusers 64 may be keyed or otherwise secured to outer housing 52. In this example, the impellers 62 are illustrated as radial type impellers but other types of impellers, e.g. axial type impellers, mixed flow type impellers, or other suitable impellers, may be used in pump 20 to construct the desired types of stages 50.

As briefly described above, however, each rotating impeller creates a relatively lower pressure at the impeller inlet compared to the pressure of fluid discharged at the impeller tip. This pressure differential creates a secondary flow of fluid from the impeller tip region to the impeller intake region of each impeller 62. Features and techniques for handling this secondary flow of fluid are discussed in greater detail below.

Figure 3:
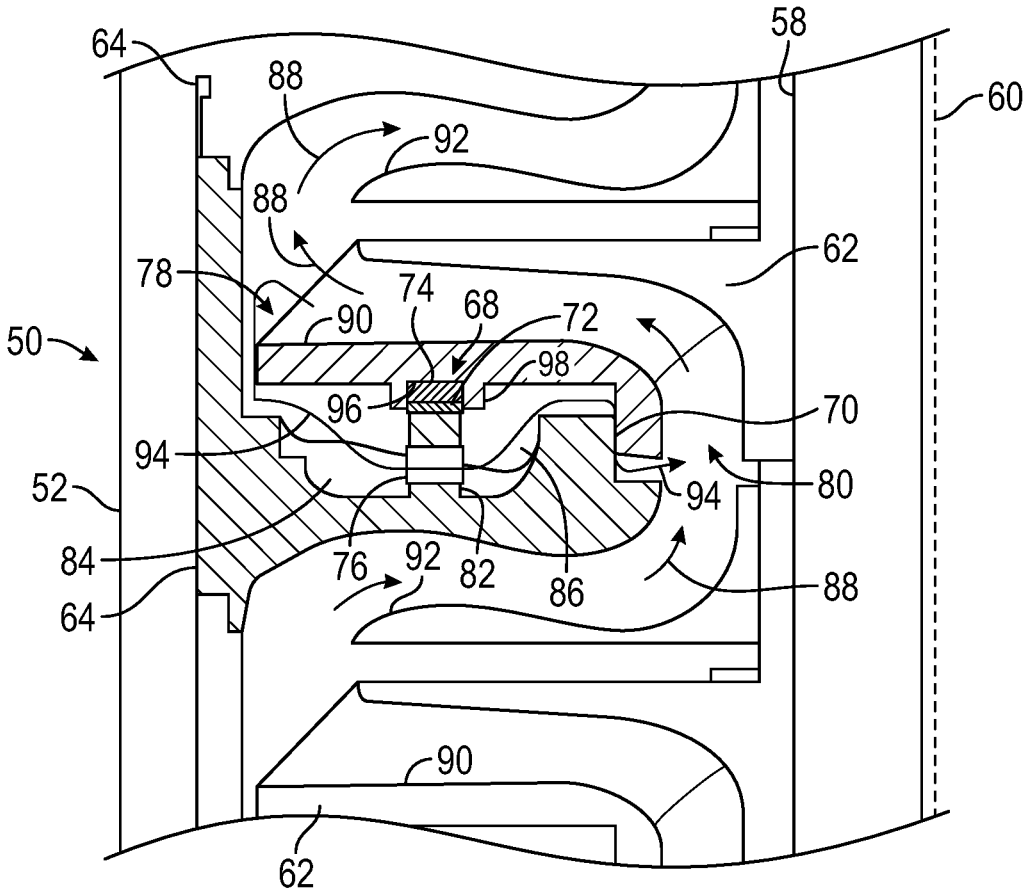
FIG. 3 is a cross-sectional illustration of an example of a sequential diffuser and impeller which may be used in the centrifugal pump illustrated in FIG. 2, according to an embodiment of the disclosure.

Referring generally to FIG. 3, a portion of the submersible pump 20 is illustrated with sequential pump stages/pairs 50. In FIG. 3, a portion of one pair 50 is shown in cross-section with one side of the impeller 62 engaged with the corresponding diffuser 64. The impeller 62 is rotationally coupled to shaft 58 and movably engaged with the corresponding diffuser 64 via a thrust device 68 and a front seal 70. In some applications, the front seal 70 may be formed generally parallel with axis 60 between sliding surfaces of the corresponding impeller 62 and diffuser 64. The thrust device 68 may comprise a downthrust assembly having a thrust pad 72 and a thrust washer 74.

The sequentially engaged impeller 62 and diffuser 64 also comprise a bypass channel 76, e.g. one or more bypass slots. It should be noted the illustrated embodiment shows bypass channel 76 disposed through a portion of diffuser 64 and thrust washer 74 mounted on impeller 62. However, this arrangement may be changed. For example, the bypass channel 76 may be disposed through a portion of impeller 62 and the thrust washer 74 may be mounted on diffuser 64. The bypass channel 76 and thrush washer 74 also can be located on the same component.

During operation of pump 20, the bypass channel 76 enables a flow of fluid (the secondary flow of fluid) from a region at a tip 78 of the impeller 62, past the thrust device 68, through the front seal 70, and to an intake or inlet region 80 of the impeller 62. The bypass channel 76 comprises at least one opening/slot, e.g. a plurality of openings, which routes at least a portion of the secondary flow of fluid around the thrust device 68 rather than through the thrust device 68.

In the embodiment illustrated, the bypass flow of fluid through bypass channel 76 prevents or limits exposure of the thrust pad 72 and/or thrust washer 74 to solids that may be carried by the secondary flow of fluid.

In the embodiment illustrated, the bypass channel 76 is formed in diffuser 64, however the bypass channel 76 can be formed through other components of pump 20, e.g. through a portion of impeller 62. By way of example, the bypass channel 76 may be formed in diffuser 64 through a pad mount structure 82 which supports thrust pad 72 and thrust washer 74 with respect to the corresponding impeller 62. In some embodiments, the bypass channel 76 may be arranged to extend between a first recess 84 and a second recess 86 which are both disposed in diffuser 64. As illustrated, the first recess 84 may be disposed radially outward of the pad mount structure 82 and the second recess 86 may be disposed radially inward of the pad mount structure. The second recess 86 may be disposed between the pad mount structure 82 and the front seal 70 such that the front seal 70 is separated from the thrust device 68. In some applications, the structure 82 and recesses 84, 86 may be formed on the impeller 62.

During operation of submersible pump 20, a primary fluid flow 88 is received by impeller 62 from an adjacent, upstream diffuser 64. The primary fluid flow 88 is directed along vanes 90 of the impeller 62 and into corresponding flow passages 92 of the next adjacent downstream diffuser 64. The primary fluid flow 88 continues along the stages 50 until discharged from submersible pump 20 at outlet 66.

Simultaneously, the lower pressure at each impeller inlet 80 relative to the pressure at the impeller tip 78 causes the secondary flow of fluid with respect to each impeller 62, as represented by arrow 94. The pressure differential between inlet 80 and tip 78 causes the flow of fluid 94 to move between the impeller 62 and diffuser 64 back to the impeller inlet region 80 as illustrated. However, the bypass channel 76 is positioned to enable the secondary flow of fluid 94 to remain separated from the thrust device 68, thus reducing the detrimental impact to thrust device components such as thrust pad 72 and thrust washer 74.

In some applications, a portion of the fluid still flows through thrust device 68, but a majority of the secondary fluid flow, i.e. fluid flow 94, is directed through bypass channel 76 so as to bypass the thrust device 68. In the illustrated embodiment, the fluid flowing through bypass channel 76 continues to move through second recess 86 and then through front seal 70 before entering impeller inlet region 80.

The thrust device 68 also may be protected from solids, e.g. sand, by various protective features. According to an embodiment, the thrust washer 74 is received in a washer recess 96 formed in a lower portion of the impeller vane 90. The washer recess 96 may be established via a thrust washer retaining feature 98 which extends to radially engage the thrust pad 72 in a manner which blocks inflow of solids into thrust device 68.

Figure 4:
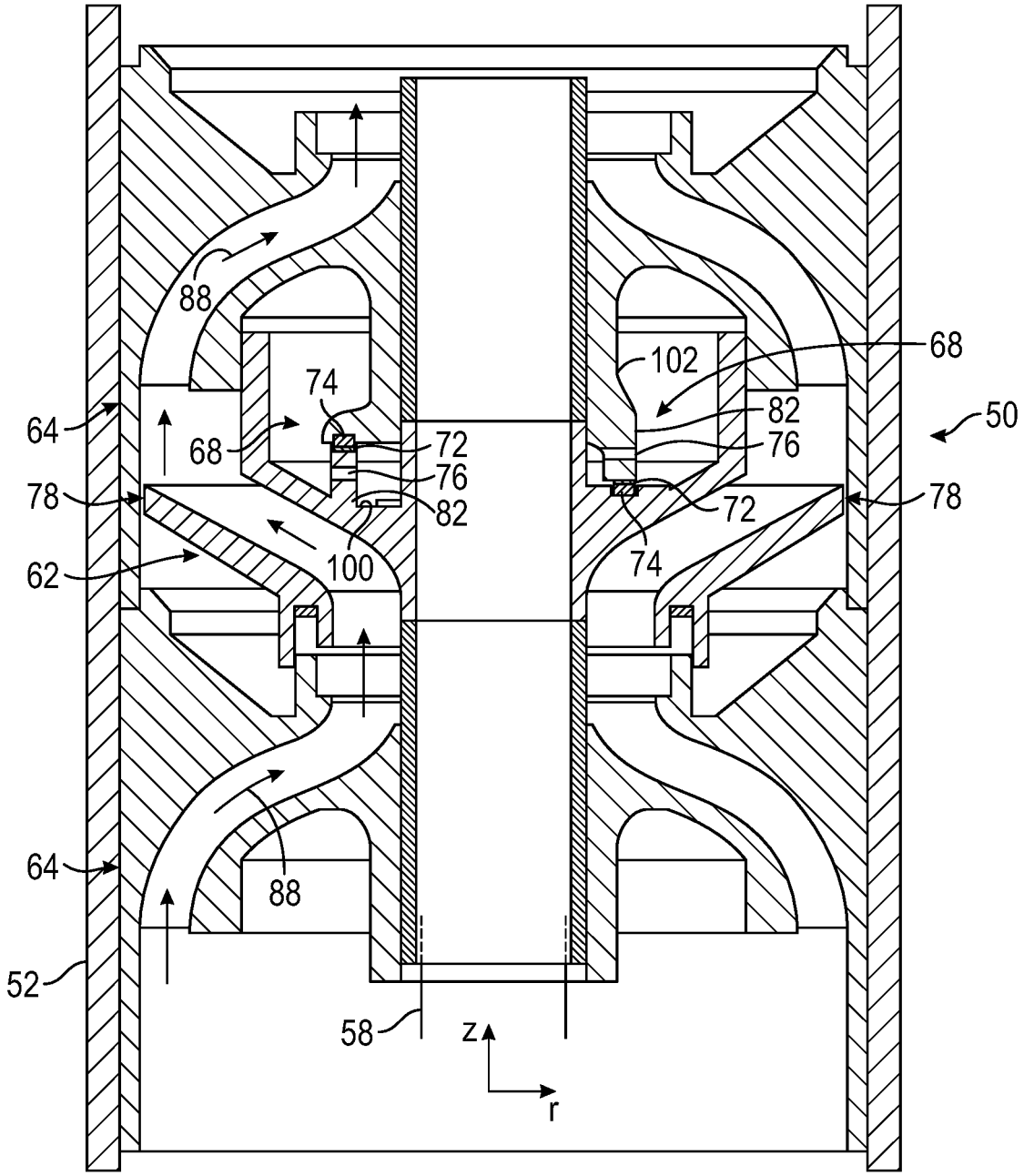
FIG. 4 is a cross-sectional illustration of another example of a sequential diffuser and impeller which may be used in the centrifugal pump illustrated in FIG. 2, according to an embodiment of the disclosure.

Referring generally to FIG. 4, another embodiment of a portion of the submersible pump 20 is illustrated with sequential pump stages/pairs 50. In FIG. 4, an embodiment of impeller 62 is illustrated as engaged with the corresponding diffuser 64. The impeller 62 is again rotationally coupled to shaft 58 and movably engaged with the corresponding diffuser 64. However, this embodiment utilizes thrust device 68 in the form of an upthrust device in which the thrust pad 72 is an upthrust pad which cooperates with corresponding thrust washer 74.

As with the previously described embodiment (see FIG. 3), the bypass channel 76 may be disposed through structure 82 used to support thrust pad 72. Again, the bypass channel 76 may be located through a portion of the impeller 62 and/or a portion of diffuser 64. In the illustration shown in FIG. 4, the illustrated left side shows an example of the bypass channel 76 through structure 82 which is part of impeller 62. For example, the structure 82 may be positioned to extend from a hub surface 100 of impeller 62. However, the illustrated left side of FIG. 4 shows an example of the bypass channel 76 through structure 82 which is part of diffuser 64. In this latter example, the structure 82 may be positioned to extend from an inner wall 102 of diffuser 64.

During operation of pump 20, the bypass channel 76 again enables the secondary flow of fluid from the vane tips 78 of the impeller 62, past the thrust device 68, and to the inlet region of the same or the next sequential impeller 62. In this embodiment, the bypass channel 76 may comprise at least one opening/slot, e.g. a plurality of openings, which routes at least a portion of the secondary flow of fluid around the thrust device 68 rather than through the thrust device 68. The bypass flow of fluid through bypass channel 76 prevents or limits exposure of the upthrust pad 72 and/or thrust washer 74 to solids that may be carried by the secondary flow of fluid.

Depending on the parameters of a given application and/or environment, the structure of pump 20 and/or submersible pumping system 22 may be adjusted. For example, the submersible pumping system 22 may be in the form of an electric submersible pumping system combined with other components for use in a wellbore or other type of borehole. Similarly, the pump stages 50 of the submersible pump 20 may comprise various impellers and diffusers as well as other components with desired configurations and features to accommodate the parameters of a given operation. The bypass channel 76 also may be formed as a single passage or a plurality of passages positioned at desired locations in the diffuser and/or other stage component. Similarly, the type of front seal, as well as the spacing of the front seal from the thrust device, may be selected according to the application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for pumping, comprising:

an electric submersible pumping system having:

a submersible motor;

a motor protector; and a submersible, centrifugal pump powered by the submersible motor, the submersible, centrifugal pump comprising a plurality of stages having pairs of cooperating impellers and diffusers, each pair having an impeller movably engaged with a corresponding diffuser via a downthrust pad assembly and a front seal, each pair further comprising a bypass channel which enables a flow of fluid from a tip of the impeller, past the downthrust pad assembly such that the flow of fluid remains separated from the down thrust pad assembly, and through the front seal during operation of the submersible, centrifugal pump, wherein the bypass channel is formed through a pad mount structure, the pad mount structure supporting the downthrust pad assembly, and a radially inward edge of the pad mount structure is radially spaced and separated from the front seal.

2. The system as recited in claim 1, wherein the downthrust pad assembly comprises a downthrust pad and a washer.

3. The system as recited in claim 2, wherein the washer is received in a washer recess of the impeller of each pair.

4. The system as recited in claim 1, wherein the bypass channel is in the diffuser of each pair.

5. The system as recited in claim 1, wherein the plurality of stages comprises a plurality of radial type stages.

6. The system as recited in claim 1, wherein the electric submersible pumping system is deployed downhole in a wellbore on a tubing.

7. The system as recited in claim 6, wherein electric power is provided to the submersible motor via a power cable routed along the tubing.

8. The system as recited in claim 1, wherein the front seal is separated from the down thrust pad assembly.

9. The system as recited in claim 1, wherein the bypass channel comprises a single passage.

10. A system for pumping, comprising:

an electric submersible pumping system having:

a submersible motor;

a motor protector; and a submersible, centrifugal pump powered by the submersible motor, the submersible, centrifugal pump comprising a plurality of stages having pairs of cooperating impellers and diffusers, each pair having an impeller movably engaged with a corresponding diffuser via a downthrust pad assembly and a front seal, each pair further comprising a bypass channel which enables a flow of fluid from a tip of the impeller, bypassing the downthrust pad assembly, and through the front seal during operation of the submersible, centrifugal pump, the bypass channel being formed through a pad mount structure, wherein the pad mount structure is positioned between a first recess formed in the corresponding diffuser and disposed radially outward of the pad mount structure and a second recess formed in the corresponding diffuser and disposed radially inward of the pad mount structure.

11. The system as recited in claim 10, wherein the front seal is separated from the downthrust pad assembly by the second recess.

12. The system as recited in claim 10, wherein the downthrust pad assembly comprises a downthrust pad and a washer.

13. The system as recited in claim 12, wherein the washer is received in a washer recess of the impeller of each pair.

14. The system as recited in claim 10, wherein the plurality of stages comprises a plurality of radial type stages.

15. The system as recited in claim 10, wherein the bypass channel comprises at least one opening.

16. The system as recited in claim 10, wherein the electric submersible pumping system is deployed downhole in a wellbore on a tubing.

17. The system as recited in claim 16, wherein electric power is provided to the submersible motor via a power cable routed along the tubing.

18. A system for pumping, comprising:

an electric submersible pumping system having:

a submersible motor;

a motor protector; and a submersible, centrifugal pump powered by the submersible motor, the submersible, centrifugal pump comprising a plurality of stages having pairs of cooperating impellers and diffusers, each pair having an impeller movably engaged with a corresponding diffuser via a thrust pad assembly and a front seal, the thrust pad assembly comprising a thrust pad and a washer supported by a pad mount structure, the pad mount structure radially separated from the front seal by a recess, each pair further comprising a bypass channel extending through the pad mount structure which enables a flow of fluid from a tip of the impeller, through the bypass channel such that the flow of fluid through the bypass channel remains separated from the thrust pad assembly, and through the front seal during operation of the submersible, centrifugal pump.

* * * * *